US006398070B1

(12) United States Patent
Uchida

(10) Patent No.: US 6,398,070 B1
(45) Date of Patent: Jun. 4, 2002

(54) AUTOMATIC PAPER FEED AND SKEW PREVENTION APPARATUS

(75) Inventor: Touru Uchida, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/467,283

(22) Filed: Dec. 20, 1999

(30) Foreign Application Priority Data

Dec. 21, 1998 (JP) ..... 10-362112

(51) Int. Cl.[7] ..... B65H 3/52
(52) U.S. Cl. ..... 221/122
(58) Field of Search ..... 271/122, 250, 271/252, 274; 198/622, 624, 635, 688.1, 836

(56) References Cited

U.S. PATENT DOCUMENTS 3,929,327 A * 12/1975 Olson ..... 271/250
4,752,432 A * 6/1988 Freeman ..... 271/35 X
5,887,866 A * 3/1999 Yamauchi et al. ..... 271/116 X
5,901,951 A * 5/1999 Yamauchi ..... 271/10.11 X
5,927,706 A * 7/1999 Hiori et al. ..... 271/117 X
5,975,516 A * 11/1999 Maruchi et al. ..... 271/10.12 X

FOREIGN PATENT DOCUMENTS

JP 62-13948 1/1987 ..... B65H/11/00
JP 9-240874 9/1997 ..... B65H/5/06

* cited by examiner

*Primary Examiner*—Christopher P. Ellis
*Assistant Examiner*—Kenneth W Bower
(74) *Attorney, Agent, or Firm*—Michael Best & Friedrich LLC; J. Warren Whitesel

(57) ABSTRACT

An automatic document feed apparatus includes a document tray having a document positioning surface extending along a transporting direction. A main roller receives a document from the document tray by rotating in the transporting direction. A return roller is pressed against the first roller and rotates in a direction opposite to the transporting direction with a constant torque. Further, a skew-corrective roller which rotates in the transporting direction is provided to prevent skewing of the document in cooperation with the second roller and the document positioning surface.

3 Claims, 5 Drawing Sheets

AUTOMATIC PAPER FEED AND SKEW PREVENTION APPARATUS

BACKGROUND OF THE INVENTION

1. Field of the Invention

The present invention relates to an automatic paper feed apparatus, particularly relates to an automatic paper feed apparatus which securely prevents skewing of transporting documents.

2. Description of the Related Art

As a first conventional example which prevents skewing of transporting documents, Japanese Utility Model Application Laid-Open No. 62-13948 proposes a technique using a document guide and a width determination plate.

Furthermore, as a second conventional example, Japanese Patent Application Lald-Open No. 9-240874 discloses a technique, which includes an image sensor for reading an image of a document, a feed roller provided In a position which faces the image sensor, a delivery roller provided on an upstream side of the image sensor, and a rubber plate member provided in a position which faces the delivery roller. A large friction area with a large coefficient of friction is formed on one portion of the feed roller in its longitudinal direction, and the rubber plate member is provided in a position of the delivery roller in its longitudinal direction which matches for the large friction area.

Therefore, according to the second conventional example, since the position of the large friction area of the feed roller matches for the position of the rubber plate member, a document can be transported suitably against a back tension generated on the document. Moreover, since the document is transported by a specified friction force even in right and left areas of the feed roller, all the documents can be transported uniformly. As a result, this technique produces an effect for efficiently preventing generation of pucker and skewing of the documents. Since the large friction area of the feed roller is provided in an approximately central portion of the longitudinal direction, the skewing of the documents at the time of transporting the documents by means of the feed roller can be efficiently prevented.

However, in the first conventional technique, since only the document guide and the width determination plate are used as means for preventing skewing, various mistakes such as miss-setting are frequently made, and thus the reliability is poor.

In addition, an object of the second conventional technique is to transport documents accurately against the back tension generated in the documents, and as a result skewing of the documents can be prevented just as a spillover effect. Therefore, similarly to the first conventional technique, skewing due to some reason cannot be reliably avoided.

SUMMARY OF THE INVENTION

The present invention is devised In such points in view in order to solve the above problems of the conventional techniques.

It is an object of the present invention to provide an automatic paper feed apparatus which is capable of preventing skewing of transporting documents completely and securely.

According to the present invention, a document tray is provided with a document positioning surface extending along a transporting direction in which a document is transported from the document tray. A main roller receives a document from the document tray by rotating in the transporting direction. A return roller is pressed against the first roller and rotates in a direction opposite to the transporting direction with a constant torque. Further, a skew-corrective roller which rotates in the transporting direction is provided to prevent skewing of the document In cooperation with the second roller and the document positioning surface.

A rotation speed of the skew-corrective roller rotates is preferably higher than that of the first roller. Further preferably, the skew-corrective roller is provided coaxlally with the second roller and at a position closer to the document positioning surface than the second roller.

A pressing means for pressing the skew-corrective roller towards the document is preferably provided to enhance the skew-correction capability of the skew-corrective roller.

BRIEF DESCRIPTION OF THE DRAWINGS

FIG. 3 is a perspective view schematically showing a driving force transmission mechanism among a return roller, an auxiliary roller, a transport roller and the like;

DETAILED DESCRIPTION OF THE PREFERRED EMBODIMENTS

An automatic paper feed apparatus according to one embodiment of the present invention will be described hereafter with reference to FIGS. 1 through 4.

Figure 1:
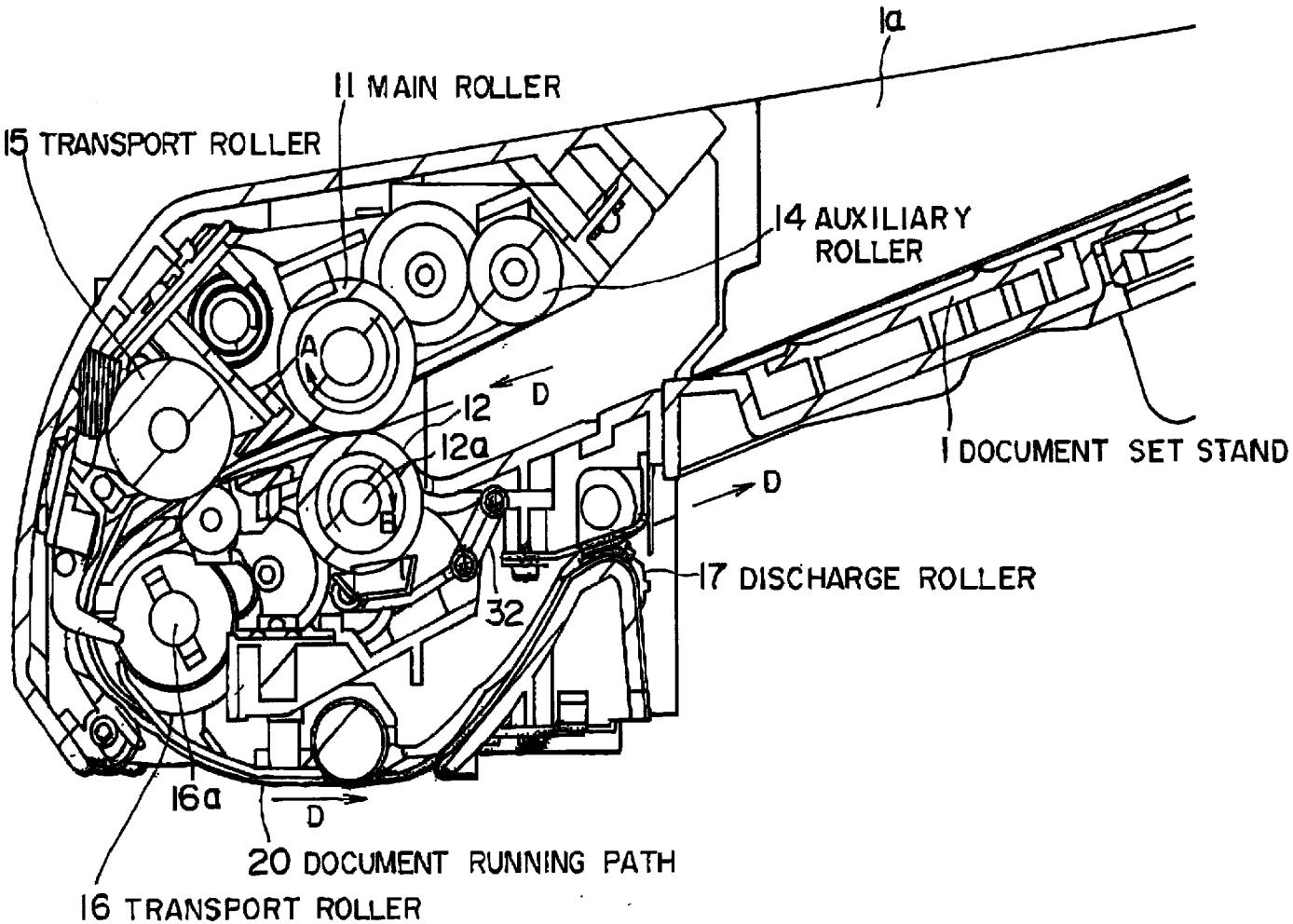
FIG. 1 is a sectional view showing an automatic feed apparatus according to one embodiment of the present invention.

As shown in FIG. 1. an automatic paper feed apparatus is composed of a document set stand or document tray 1 on which a plurality of documents are stacked, a document positioning surface 1*a* provided on a side surface of the document set stand 1, a main roller 11 for successively catching the stacked documents from its top one, a return roller 12 for preventing the second and thereafter documents from being caught, a correction roller 13 (see FIGS. 2 and 3) provided coaxially with the return roller 12 on a side of the document positioning surface 1*a* from the return roller 12, and an auxiliary roller 14 for feeding the documents stacked on the document set stand 1 to the main roller 11.

The documents which were caught by the main roller 11 pass through a document running path 20 by a transport roller 15, a transport roller 16 and a discharge roller 17 so as to be discharged out of the apparatus.

Figure 3:
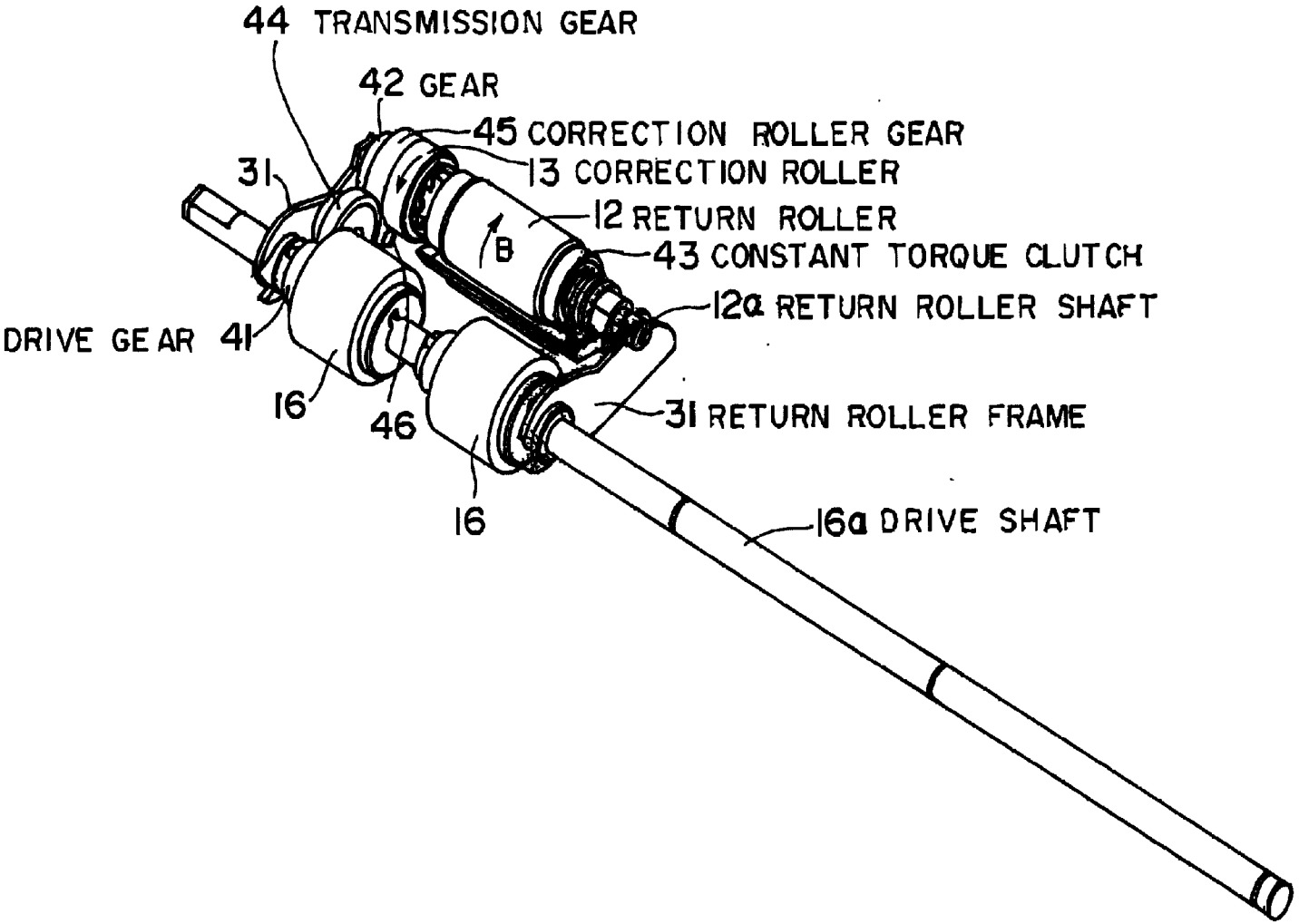
Figure 4:
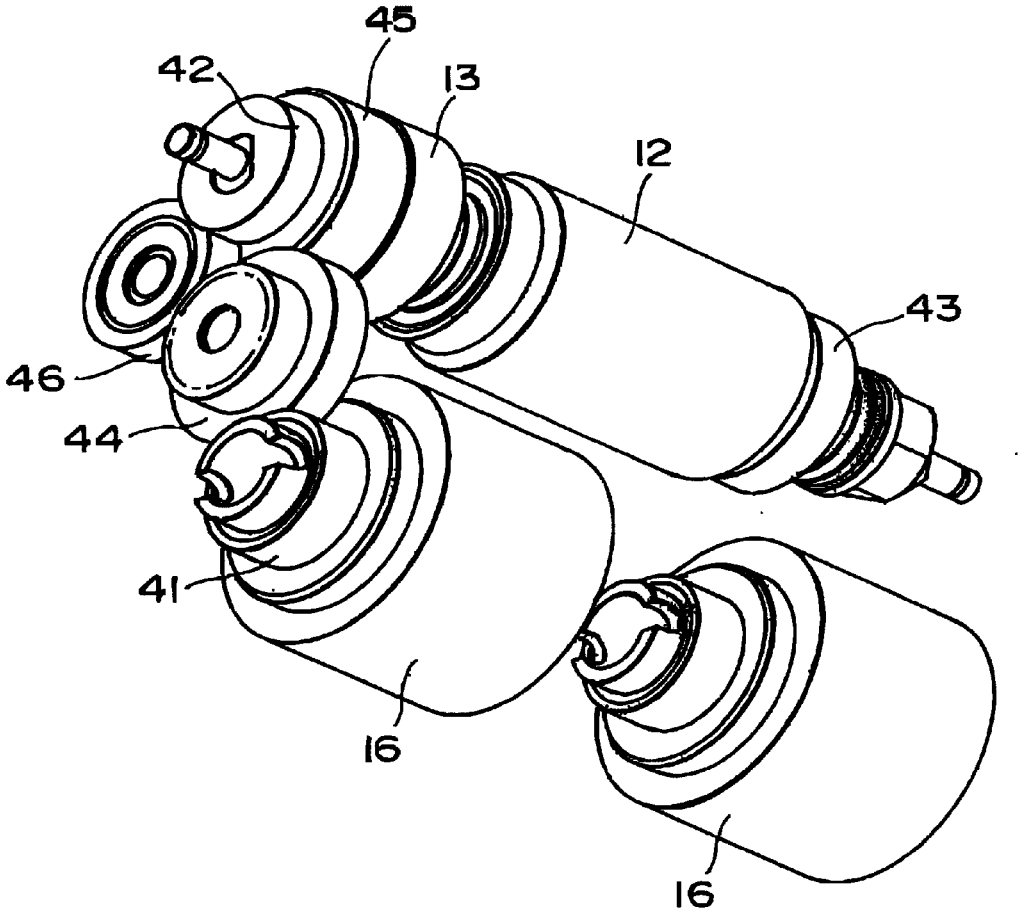
FIG. 4 is an enlarged perspective view of the driving force transmission mechanism by means of a gear shown in FIG. 3.

The return roller 12 is held by return roller frames 31, 31, as shown in FIG. 3, which are rotatably mounted to a drive shaft 16*a* of the transport roller 16 and as shown in FIG. 1 the return roller 12 is pressed against the main roller 11 by a spring 32. The two return roller frames 31, 31 are connected with each other by a connecting member (not shown).

A driving force of the return roller 12 in a direction of an arrow B (see FIGS. 1 and 3) is transmitted from a drive gear 41 composed integrally with the transport roller 16 to a gear 42 fixed to a return roller shaft 12*a* via a series of gears including transmission gears 44 (small diameter portion (see FIG. 4)) and 46 on the return roller frame 31, and further is transmitted via a constant torque clutch 43 provided between the return roller shaft 12*a* and the return roller 12. Therefore, the constant driving force in the direction of the arrow B is transmitted to the return roller 12.

Figure 2:
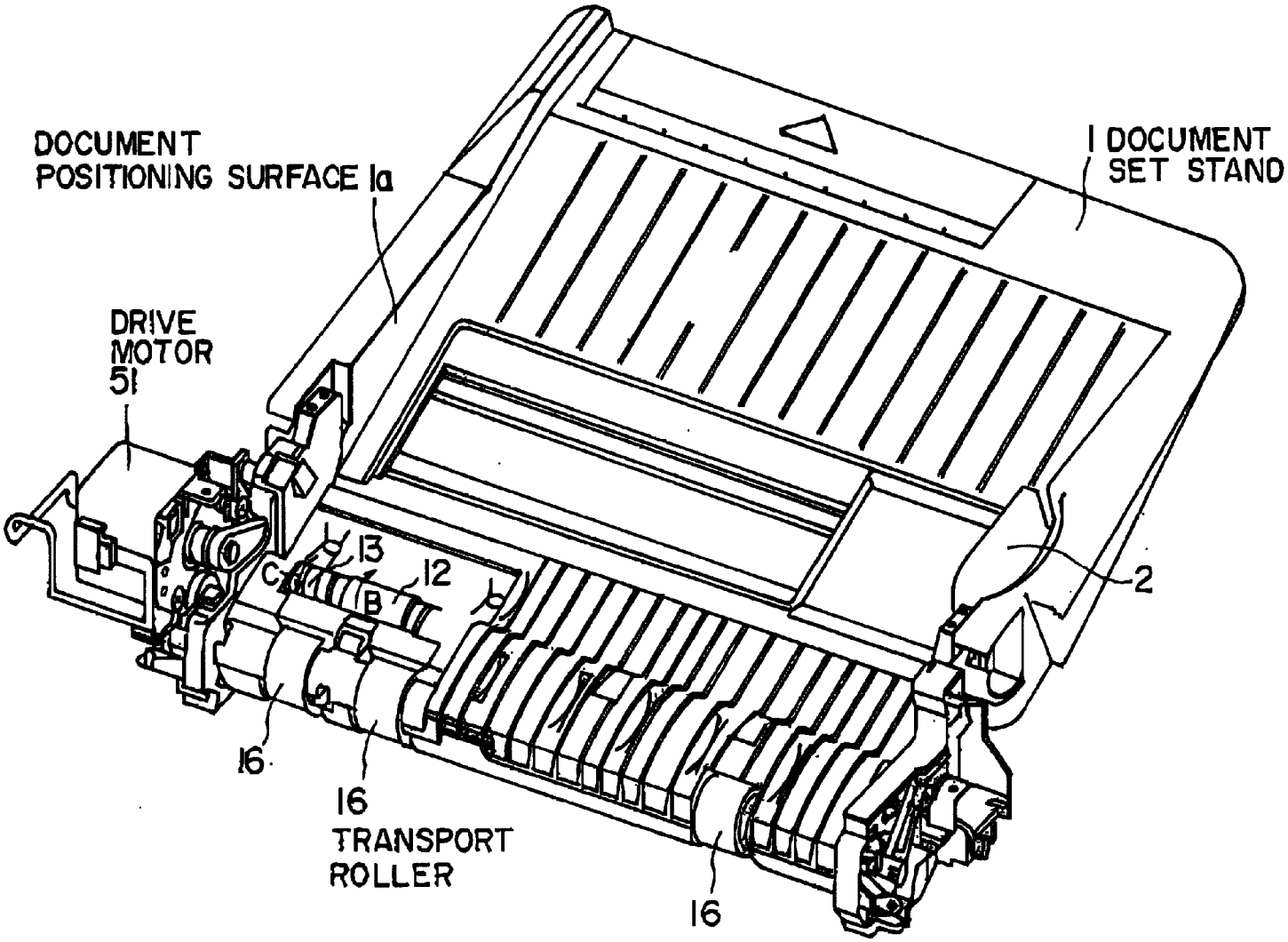
FIG. 2 is a perspective view that a document transporting surface of the automatic paper feed apparatus of the present invention is viewed from a slantingly upper direction.

The correction roller 13 is rotated in a direction of an arrow C of FIGS. 2 and 3 by a driving force which is transmitted from the drive gear 41 via the transmission gear 44 (large diameter portion) on the return roller frame 31 to a correction roller gear 45. The gear 42 and the correction roller gear 45 are operated independently.

A gear ratio from the drive gear 41 to the correction roller gear 45 is set so that a peripheral speed of the correction roller 13 is approximately equal to or slightly higher than a document transport speed of the main roller 11.

Here, the correction roller 13 is composed integrally with the correction roller gear 45 and is freely rotatable with respect to the return roller shaft 12*a*. Therefore, the correction roller 13 is driven in the direction of the arrow C at the document transport speed of the main roller 11.

There will be detailed an operation of the embodiment of the present invention hereinafter.

When a drive motor 51 (see FIG. 2) rotates, Its driving force Is transmitted via the transmission mechanism (not shown) to the main roller 11, the transport roller 15, the transport roller 16 and the discharge roller 17. Then, the auxiliary roller 14 descends and the documents are caught by the main roller 11 as shown in FIG. 1.

In this embodiment, the auxiliary roller 14 is moved up and down and is driven by a mechanism which is realized by a technique disclosed in Japanese Patent Application Laid-Open No. 7-41191. For this reason, the transport speed of the main roller 11 is set to be slower than the document transport speed.

Figure 5:
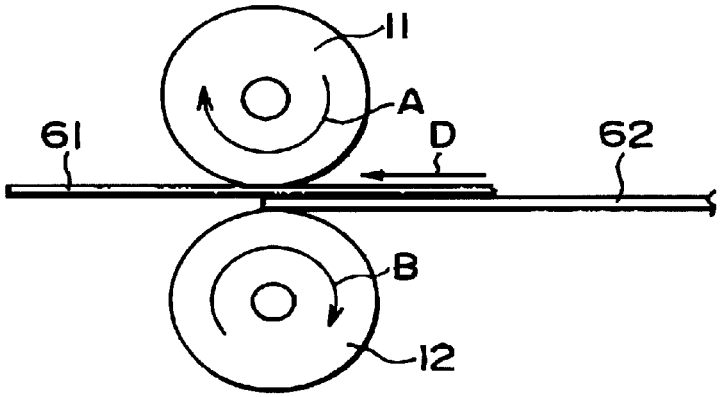
FIG. 5 is a diagram for explaining an operation of the return roller and a main roller of the present invention.

Thereafter as shown in FIG. 5, a first document 61 is caught by the main roller 11 and is carried in the direction of an arrow D. A second document 62 is stopped in a state that it is slightly caught by the main roller 11 and the return roller 12.

Furthermore, when a backward end of the first document 61 passes through the main roller 11, the main roller 11 and the return roller 12 slightly rotate reversibly so as to push back the second document 62 slightly. This is because the driving speed of the main roller 11 is slower than the document transport speed, and thus the driving force is not applied to the main roller 11 until play of the driving has been absorbed.

Figure 6:
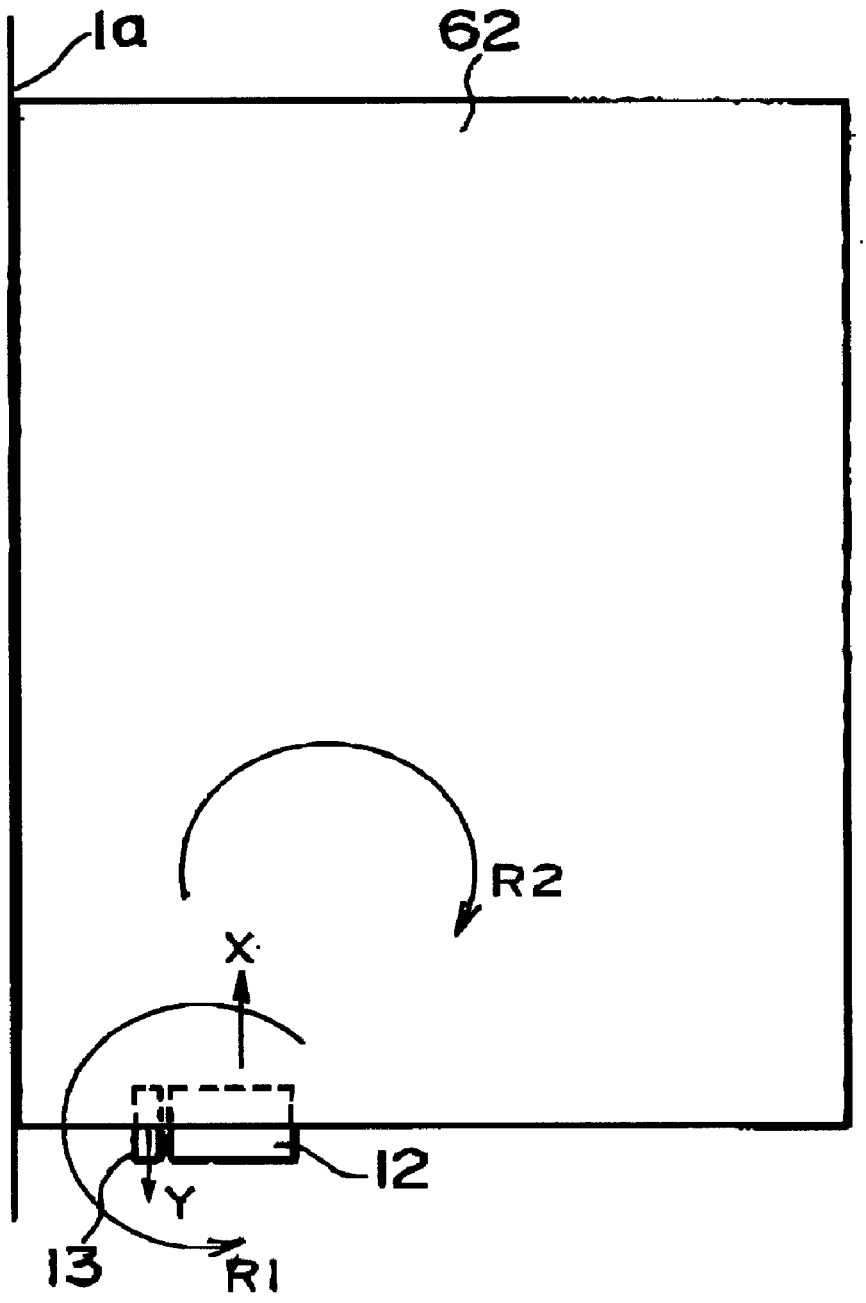
FIG. 6 is a diagram for explaining an operation of the auxiliary roller.

Therefore, at the moment that the backward end of the first document 61 passes through the main roller 11, a force in a direction of an arrow X in FIG. 6 is applied to the second document 62 by the return roller 12.

Furthermore, since a force in the direction of an arrow Y is kept being applied to the second document 62 by the correction roller 13, a force obtained by adding the above two forces, namely, a rotating force in a direction of an arrow R1 is applied to the second document 62, but since there exists the document positioning surface 1*a*, needless to say, the document cannot rotate.

Here, if the correction roller 13 is not provided, only the force in the direction of the arrow x is applied to the second document 62, and thus the rotating force in an direction of an arrow R2 is applied to the document 62 by an inertia force. As a result, if a width determination portion 2 does not hold the end surface of the document, the document rotates in the direction R2, resulting in skewed document.

Here, when the peripheral speed of the correction roller 13 is slower than the document transport speed of the main roller 11, the transport speed on the side of the correction roller 13 becomes slow during the transportation of the document. As a result, the document tries to rotate in the direction R2, and thus it causes skewing.

Therefore, it is preferable that the transport speed of the correction roller 13 is set to be slightly faster so that even it the diameter of rollers slightly changes, the transport speed of the correction roller 13 does not become slower than the transport speed of the main roller 11.

In the case where the transport speed of the correction roller 13 is fast, the force is applied to the document in the direction of the arrow R1, and the document is pressed against the document positioning surface 1*a*. As a result, needless to say, the skewing does not occur.

There will be described below another embodiment of the present invention.

According to the above-mentioned embodiment of the present invention, document pressing means is not provided to the correction roller 13, but when generally known auxiliary pressing means such as a plate spring and a weight are added, the operation of the correction roller 13 is further stabilized.

The present invention is constituted and functions as mentioned above, and the present invention produces the following effects.

According to the present invention, since the rotating force in the direction of the arrow R1 is applied to a document by the correction roller 13, even if the width determination portion 2 is not set securely, skewing of the document can be prevented.

What is claimed is:

1. An automatic document feed apparatus comprising:

a document position surface provided in a document tray and extending along a transporting direction in which a document is transported from the document tray;

a first roller for receiving a document from the document tray by rotating in the transporting direction;

a second roller which is pressed against the first roller, the second roller rotating in a direction opposite to the transporting direction with a constant torque; and a skew-corrective roller which rotates in the transporting direction to prevent a skewing of the document in cooperation with a second roller and the document position surface, wherein the skew-corrective roller is provided coaxially with the second roller and at a position closer to the document positioning surface than the second roller.

2. An automatic document feed apparatus according to claim 1 wherein the skew-corrective roller is provided coaxially with the second roller and at a position closer to the document positioning surface than the second roller.

3. An automatic document feed apparatus comprising:

a document positioning surface provided in a document tray and extending along a transporting direction in which a document is transported from the document tray;

a first roller for receiving a document from the document tray by rotating in the transporting direction;

a second roller which is pressed against the first roller, the second roller rotating in a direction opposite to the transporting direction with a constant torque; and a skew-corrective roller which rotates in the transporting direction to prevent skewing of the document in cooperation with a second roller and the document position surface, wherein a combination of the second roller and the skew-corrective roller causes a rotation force to be applied to a document stopped by the document positioning surface.

* * * * *